United States Patent [19]

Stepniak et al.

[11] Patent Number: 4,600,260

[45] Date of Patent: Jul. 15, 1986

[54] ELECTRICAL CONNECTOR

[75] Inventors: Frank M. Stepniak, Long Valley; Andrew A. Kominiak, Flanders, both of N.J.

[73] Assignee: Amerace Corporation, Hackettstown, N.J.

[21] Appl. No.: 334,587

[22] Filed: Dec. 28, 1981

[51] Int. Cl.[4] ..... H01R 13/52

[52] U.S. Cl. ..... 339/111

[58] Field of Search ..... 339/111, 80

[56] References Cited

U.S. PATENT DOCUMENTS 3,989,341 2/1976 Ball ..... 339/111

*Primary Examiner*—Gil Weidenfeld
*Assistant Examiner*—David L. Pirlot
*Attorney, Agent, or Firm*—David Teschner; Arthur Jacob

[57] ABSTRACT

An electrical connector for use in connecting a male contact to a female contact in an energized high voltage circuit, the electrical connector having a female contact assembly which is movable and is accelerated in response to the generation of arc-quenching gases within the electrical connector to aid in more rapidly closing the connection between the female contact and the male contact, and kinetic energy absorption and dissipation means for gradually absorbing and dissipating at least a portion of the kinetic energy imparted to the female contact assembly as a result of such acceleration thereof, so as to decelerate the female contact assembly and thereby facilitate bringing the female contact assembly to a halt subsequent to closing the connection.

42 Claims, 8 Drawing Figures

ELECTRICAL CONNECTOR

The present invention relates generally to electrical connectors and pertains, more specifically, to electrical connectors of the type used in making a connection in an energized high voltage circuit of an electrical distribution system.

As set forth in some detail in our earlier U.S. Pat. No. 4,186,985, one of the more troublesome situations which arises in the joinder of male and female contact elements in an energized high voltage circuit is the large amount of arc-quenching gases generated during fault closure and the concomitant high gas-generated pressures which must be accommodated by the connector. The aforesaid patent traces the development of prior art devices which are intended for fault closure and discloses an improvement which aids in accommodating fault closure. These prior art devices employ a piston-driven movable female contact assembly which is moved toward a separable male contact by the arc-quenching gases so as to accelerate engagement of the contacts, thus minimizing arcing time.

It is an object of the present invention to provide an electrical connector of the type described; that is, an electrical connector in which one contact is moved by arc-quenching gases into accelerated contact with an inserted complementary contact, and which will operate effectively at higher voltages than earlier such devices.

Another object of the invention is to provide an electrical connector of the type described and in which the movable contact assembly may be accelerated to a greater speed and then stopped, subsequent to making contact, without a catastrophic failure within the connector.

Still another object of the invention is to provide an electrical connector of the type described and in which the movable contact assembly is decelerated by kinetic energy absorption and dissipation means, thereby enabling the accommodation of higher arc-quenching gas pressures and concomitant higher speeds of movement of the movable contact assembly.

Yet another object of the invention is to provide an electrical connector which employs the proved construction arrangement of previous movable contact assembly connectors together with improvements which render the electrical connector suitable for use in making fault closure connections at significantly higher voltages.

A further object of the invention is to provide an electrical connector of the type described and which includes an external configuration that renders the connector compatible with existing high voltage electrical distribution systems.

The above objects, as well as still further objects and advantages, are attained by the present invention which may be described briefly as an improvement in an electrical connector of the type in which a contact element assembly is movable within the electrical connector from a first position to a second position to accelerate a first contact element for rapid movement toward engagement with a complementary second contact element brought toward separable engagement with the first contact element within the electrical connector to complete an energized high voltage circuit, the improvement comprising kinetic energy absorption and dissipation means associated with the electrical connector for gradually absorbing and dissipating at least a portion of the kinetic energy imparted to the contact element assembly as a result of such acceleration as the contact element assembly moves from the first position toward the second position so as subsequently to decelerate the contact element assembly and thereby facilitate bringing the contact element assembly to a halt subsequent to the engagement of the first and second contact elements.

The invention will be more fully understood, while still further objects and advantages will become apparent in the following detailed description of embodiments of the invention illustrated in the accompanying drawing, in which.

Figure 1:
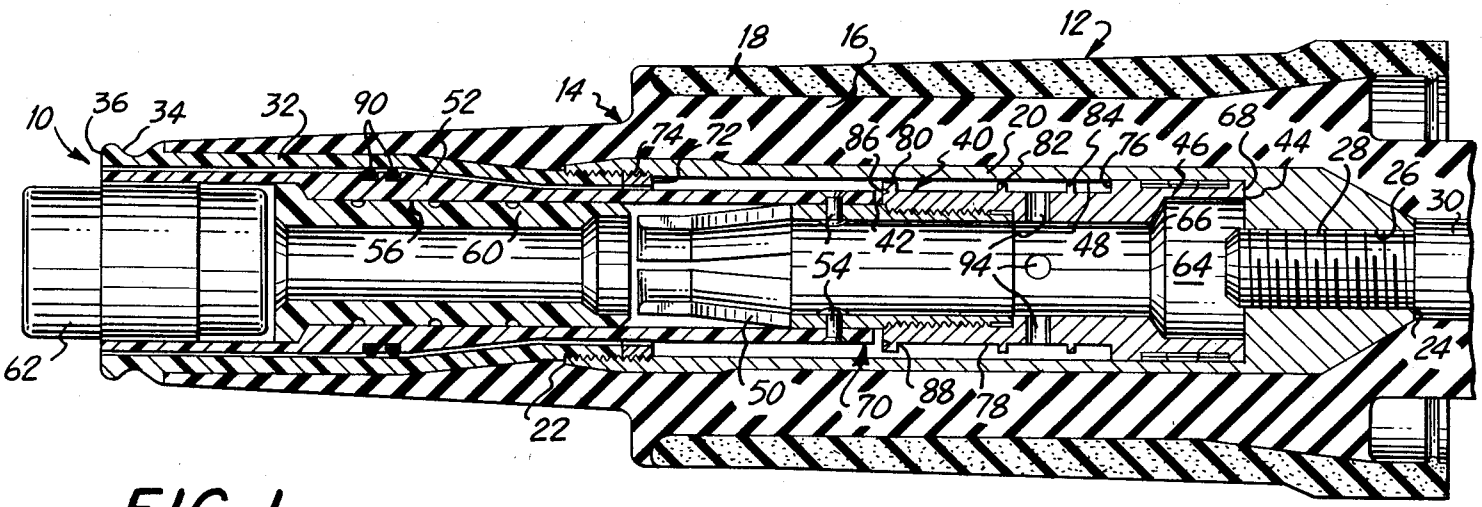
FIG. 1 is a longitudinal cross-sectional view of the forward portion of an electrical connector element constructed in accordance with the invention.

Referring now to the drawing, and especially to FIG. 1 thereof, a forward portion of a female electrical connector element constructed in accordance with the invention and shown in the form of a bushing insert is illustrated generally at 10. Bushing insert 10 is for use in separable connection with a complementary male connector element, such as a connector elbow (not shown), in an energized high voltage circuit of an electrical distribution system (also not shown).

Bushing insert 10 has a housing 12 which includes an outer housing casing 14 of elastomeric materials having an inner portion 16 of insulating elastomeric material and an outer portion 18 of conductive elastomeric material molded integral with inner portion 16. Housing 12 further includes a rigid, metallic, electrically conductive inner housing member 20 which extends longitudinally between a forward end 22 and a rearward end 24 within casing 14. A threaded aperture 26 at the rearward end 24 receives a threaded stud 28 which is unitary with one end of a metallic, electrically conductive extension 30 which itself is threaded at the other end thereof (not shown) for attachment to a high voltage circuit, such as at the terminal of a transformer (not shown). A tubular insulating nosepiece 32 is threaded into the inner housing member 20 at the forward end 22 thereof and projects axially therefrom, in a manner now well-known in bushing inserts, and carries an annular detent groove 34 adjacent the forward end 36 thereof for engaging a complementary detent in the male connector element which will be connected with the bushing insert 10.

Located within the inner housing member 20 is a carrier member 40 which is generally tubular and extends between forward end 42 and rearward end 44, corresponding to the forward and rearward ends 22 and 24 of the inner housing member 20. A piston 46 is unitary with the carrier member 40 adjacent rearward end 44 and is received within cylindrical inner surface 48 of inner housing member 20 for axial sliding movement. A female contact element 50 is threaded into the carrier member 40 at the forward end 42 thereof so as to be integral with the carrier member 40 and movable axially with movement of the piston 46 and the carrier member 40. A tubular sleeve 52 of relatively soft insulating plastic material is secured to the female contact element 50 as by fasteners 54 and extends forward beyond the forward end of the female contact element 50 to provide a forward tubular portion 56 within which there is seated a first tubular guide 60, aligned axially with the female contact element 50, and a second tubular guide 62, also sligned axially with the female contact element, both guides 60 and 62 being affixed to the tubular portion 56. Guide 60 is constructed of a material from which arc-quenching gases will evolve in response to an arc being struck between an inserted male contact element (not shown) and the female contact element 50, and each guide 60 and 62 serves to receive and guide a follower (not shown) of arc-quenching gas-evolving material which projects from the male contact element and precedes the male contact element as contact is made with the female contact element 50. Guide 62 provides a sealing arrangement for confining the arc-quenching gases as the gases are evolved within bushing insert 10, in a manner already known in the art.

Figure 2:
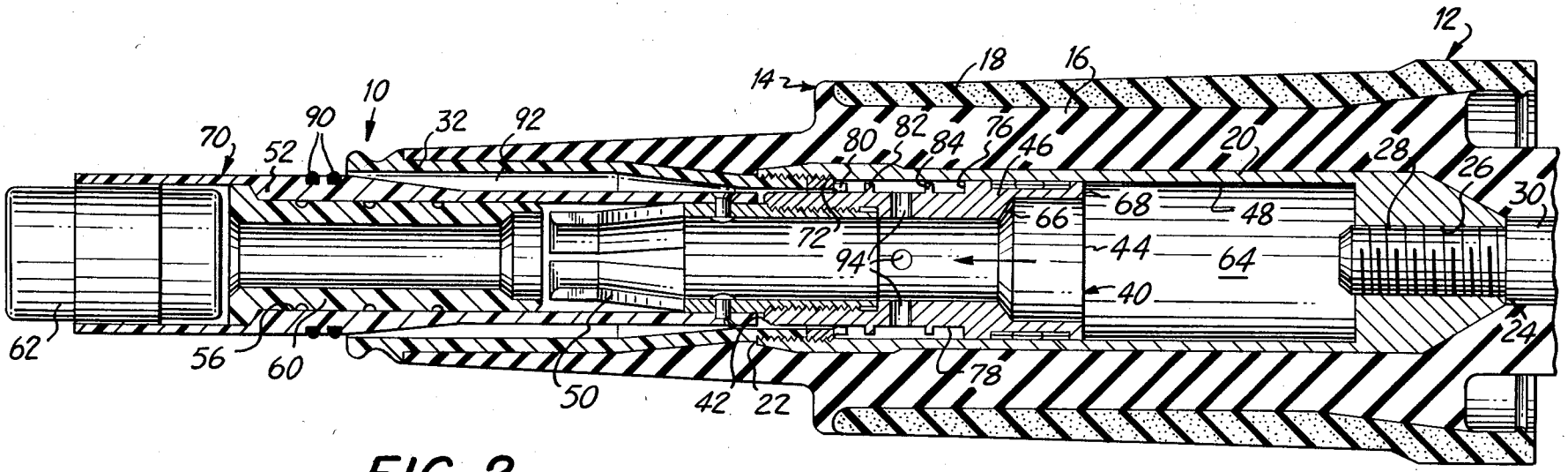
FIG. 2 is a view similar to FIG. 1, but with the component parts in another operating position.
Figure 3:
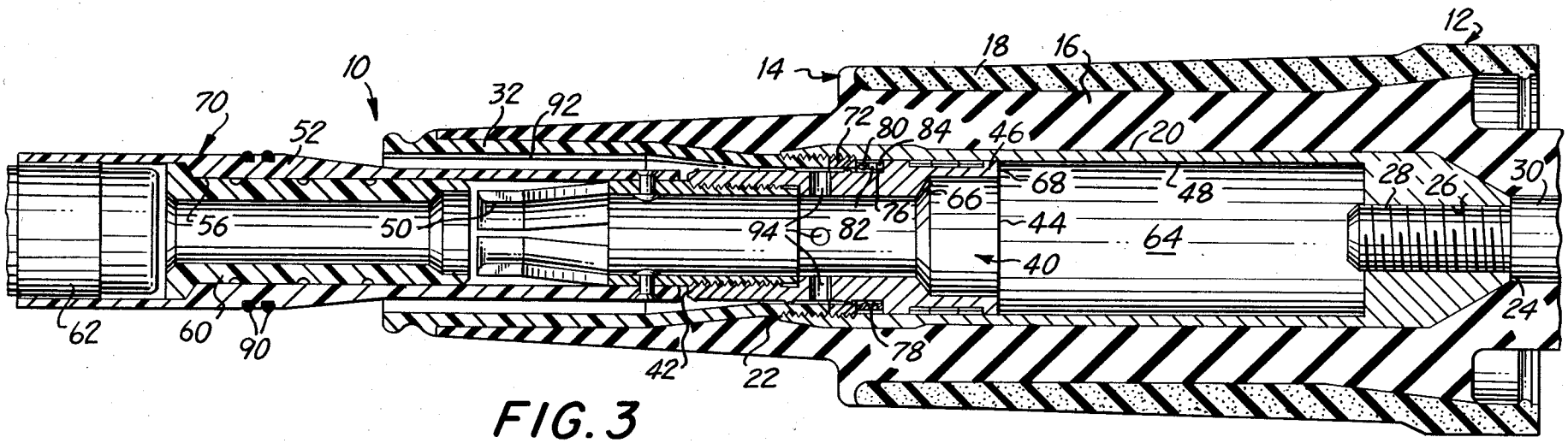
FIG. 3 is a view similar to FIG. 1, but with the component parts in still another operating position.

Upon insertion of the male contact element into guides 60 and 62, under circumstances where the high voltage circuit is energized, an arc will be struck between the male contact element and the female contact element 50 prior to actual physical contact between those elements. The gas-evolving materials present in the male contact element follower and in the guide 60 will emit arc-quenching gases which will flow rearwardly into a chamber 64 located adjacent transverse surfaces 66 and 68 of piston 46. The pressure built up by gases in chamber 64 will act upon the piston 46 to move the piston 46 forward, out of the position shown in FIG. 1, toward the position shown in FIG. 2, thereby moving the entire female contact assembly 70, which includes carrier member 40, female contact element 50 and guides 60 and 62, in an axially forward direction. Forward axial movement of the female contact assembly 70 will be continued until piston 46 reaches the position illustrated in FIG. 3, at which position the male contact element and the female contact element 50 will be fully engaged and the female contact assembly 70 will be stopped. Thus, female contact assembly 70 will travel axially, in response to the generation of arc-quenching gases, from an initial retracted location, as seen in FIG. 1, to a final advanced location, as seen in FIG. 3, passing through an intermediate location, as depicted in FIG. 2.

Under fault closing conditions, the arc struck between the male contact element and the female contact element very quickly will generate a relatively large volume of gases, especially in circuits where the voltages can be as high as about 35 kV. In addition, the higher voltages will produce an arc of greater axial length, requiring a greater length of travel between the retracted location and the advanced location of the female contact assembly. Under such circumstances the piston 46, and indeed the entire female contact assembly 70, will be accelerated to a relatively high speed and will possess a considerable amount of kinetic energy during travel from the retracted location to the advanced location. In order to enable bushing insert 10 to function appropriately during a fault closing condition at such high voltages, without a catastrophic failure, the structure of bushing insert 10 must accommodate the high speed of the female contact assembly 70, and the concomitant great amount of kinetic energy imparted to the female contact assembly 70, in order to decelerate and bring the female contact assemby 70 to a halt at the advanced location. Thus, bushing insert 10 includes kinetic energy absorption and dissipation means for absorbing and dissipating the kinetic energy of female contact assembly 70 as the assembly moves toward the advanced location.

Referring now to FIGS. 1 through 4, the kinetic energy absorption and dissipation means is constructed as follows. A stop member in the form of a ring 72 of relatively hard metal is affixed to the inner housing member 20 adjacent the forward end 22 by means of a threaded connection at 74. A stop shoulder 76 is located on the carrier member 40 at the forward end of piston 46. Carrier member 40 has an outer cylindrical surface 78 which is spaced radially inwardly from cylindrical inner surface 48 of innser housing member 20. When piston 46 is in the position illustrated in FIG. 1, with the female contact assembly 70, and carrier member 40, in the retracted location, stop shoulder 76 is spaced axially rearwardly from stop ring 72. Shearable members in the form of shearable rings 80, 82 and 84 are unitary with carrier member 40 and project radially outwardly toward inner housing member 20 to establish shearable means. Primary shearable ring 80 is located adjacent the forward end 42 of carrier member 40 to provide a primary shearable structure while secondary shearable rings 82 and 84 are spaced axially from primary shearable ring 80 and from one another to provide a secondary shearable structure. Primary shearable ring 80 is spaced axially rearwardly from stop ring 72.

Upon the striking of an arc, and the consequent generation of arc-quenching gases, the female contact assembly 70 will be accelerated for rapid movement forward from the initial location, depicted in FIG. 1, and over the length of travel defined by the axial spacing between primary shearable ring 80 and stop ring 72. Such unimpeded acceleration will result in high speed travel of the female contact assembly enabling rapid closing of the gap between the male contact element and the female contact element 50 and consequent reduction of arcing time. Initial contact will be made between the male contact element and female contact element 50, and the arc will be extinguished, when the female contact assembly 70 is in the vicinity of the intermediate location shown in FIG. 2.

Figure 4:
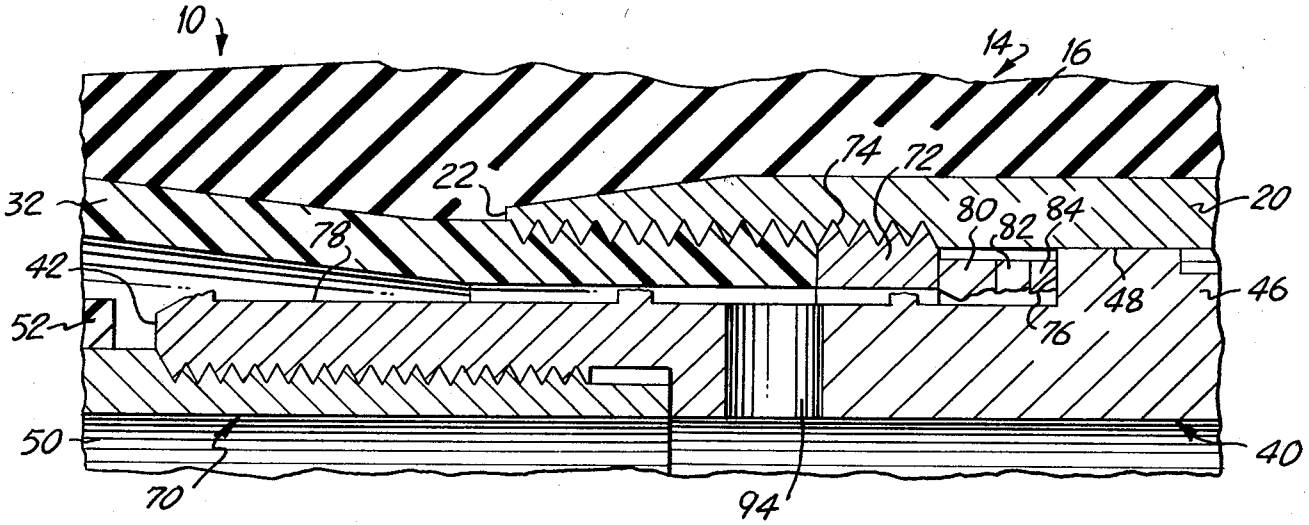
FIG. 4 is an enlarged fragmentary view of a portion of FIG. 3.

Further forward movement of the female contact assembly 70 will facilitate completion of the connection, but need not be as rapid as the initial movement necessary to effect direct contact between the male and female contact elements. Therefore, deceleration can take place during such further forward movement so that the female contact assembly 70 can be stopped when the advanced location is reached, as shown in FIG. 3, without failure of the bushing insert 10. Deceleration takes place as a result of the absorption and dissipation of at least a portion of the kinetic energy of the female contact assembly 70 as each of the shearable rings 80, 82 and 84 is sheared from the carrier member 40. Thus, as primary shearable ring 80 moves forward it will be intercepted by ring 72 which is stationary and projects into the path of travel of shearable ring 80 so as to shear the shearable ring 80 from the carrier member 40. Such shearing will absorb and dissipate enough of the kinetic energy of the forwardly-moving female contact assembly 70 to be significant in effecting some deceleration. A notch 86 is provided at the root 88 of shearable ring 80 to assure that shearing will take place cleanly and at the root 88. Continued forward travel of the female contact assembly 70 will bring secondary ring 82 into engagement with sheared primary ring 80 and will effect the shearing of secondary ring 82 from the carrier member 40, accomplishing further deceleration through the absorption and dissipation of more of the kinetic energy imparted to female contact assembly 70. Likewise, secondary shearable ring 84 will be engaged with previously-sheared ring 82 to further decelerate female contact assembly 70 so that upon reaching the advanced location shown in FIG. 3, stop shoulder 76 will be coupled with stationary ring 72, through the sheared rings 80, 82 and 84 as seen in FIG. 4, and piston 46 will be brought to a halt, together with the remainder of female contact assembly 70. The gradual absorption and dissipation of kinetic energy brought about by the serial shearing of rings 80, 82 and 84 serves to decelerate and aid in bringing to a stop the female contact assembly 70 without a catastrophic failure of the bushing insert 10 so that the completed electrical connection will remain intact. The provision of secondary rings 82 and 84 assures that the greatest portion of the kinetic energy absorbed and dissipated by the absorption and dissipation means is absorbed and dissipated as the female contact assembly 70 travels from the intermediate location to the advanced location so that maximum deceleration takes place after contact is made between female contact element 50 and the male contact element.

Under normal circuit closure conditions, when the circuit is energized but no fault is present, primary shearable ring 80 will not be sheared from carrier member 40 and serves as a stop ring to limit the travel of female contact assembly 70 only to that travel which facilitates switching. During such travel, arc-quenching gases are contained within the bushing insert 10 and seals 90, which are carried by tubular sleeve 52, are provided to maintain such containment as the female contact assembly 70 moves forward. However, under a fault closing condition, seals 90 pass beyond the forward end 36 of tubular nosepiece 32 and open a passage 92 to vent ports 94 in carrier member 40 to enable the venting of excessive arc-quenching gases. Seals 90 provide an important function in that they assure that adequate arc-quenching gases will be present for extinguishing an arc during disconnection under energized conditions.

Figure 5:
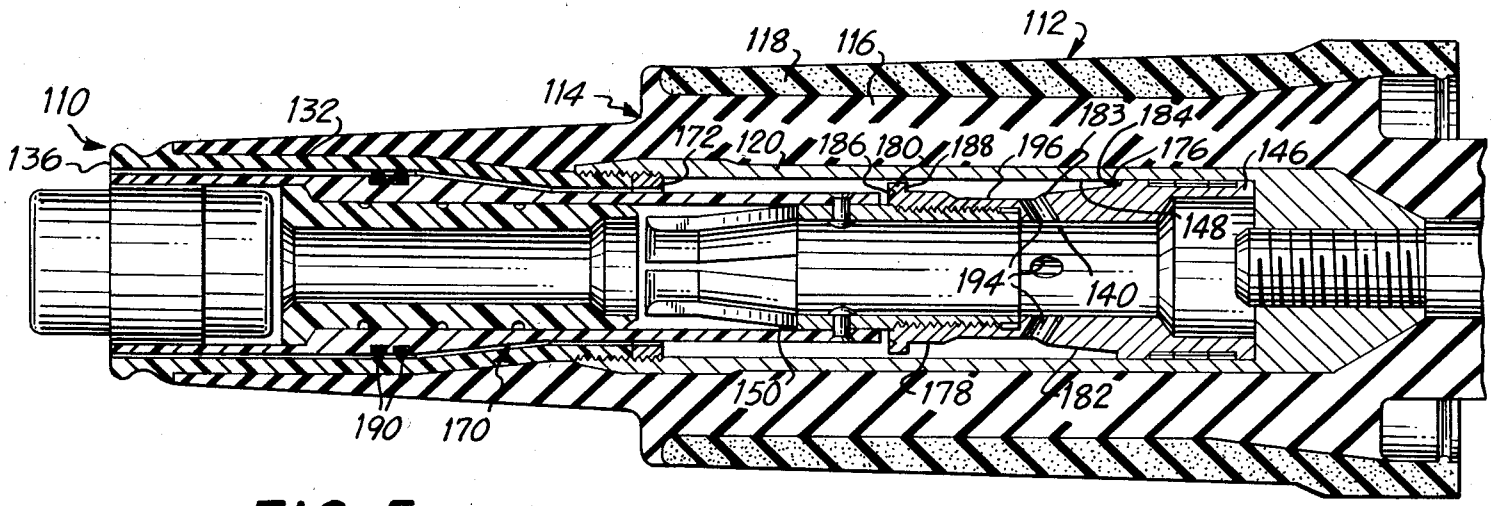
FIG. 5 is a longitudinal cross-sectional view of the forward portion of another electrical connector element constructed in accordance with the invention.
Figure 6:
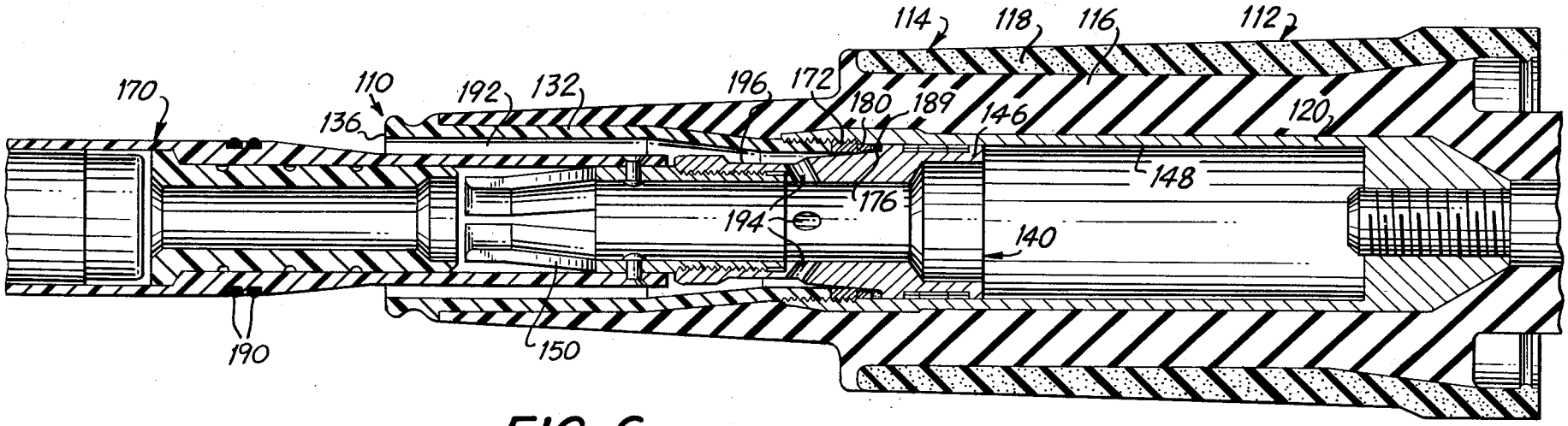
FIG. 6 is a view similar to FIG. 5, but with the component parts in another operating position.

Turning now to FIGS. 5 and 6, a forward portion of another female electrical connector element constructed in accordance with the invention is shown in the form of a forward portion of bushing insert 110. Bushing insert 110 is similar to the above-described bushing insert 10 in that a housing 112 includes an outer housing casing 114 with inner and outer portions 116 and 118 of insulating and conductive elastomeric materials, respectively, and a rigid, metallic inner tubular housing member 120. A tubular insulating nosepiece 132 is threaded into housing member 120 and has a forward end 136.

A tubular carrier member 140 includes a piston 146 unitary therewith and received within a cylindrical inner surface 148 of the housing member 120. A female contact element 150 is threaded into the carrier member 140 so that the carrier member 140, the piston 146 and the female contact element 150 all are parts of an axially movable female contact assembly 170.

A kinetic energy absorption and dissipation means includes a shearing ring 172 affixed to the inner housing member 120, as in the earlier-described embodiment, and a stop shoulder 176 at the forward end of the piston 146. A shearable structure is provided on the outer surface 178 of the carrier member 140 and, as before, includes a primary shearable structure in the form of a shearable ring 180 located adjacent the forward end of the carrier member 140. In this instance, however, a secondary shearable structure is in the form of a tapered portion 182 located on the carrier member 140 axially between the shearable ring 180 and stop shoulder 176 of piston 146. The tapered portion 182 extends from an axially-forward smaller radius at 183 rearwardly to an axially-rearward larger radius at 184. Upon forward axial movement of the female contact assembly 170 from the retracted location shown in FIG. 5 to the advanced location illustrated in FIG. 6, shearable ring 180 will be engaged by shearing ring 172 and will be sheared from carrier member 140, with the aid of notch 186 at root 188, and the tapered portion 182 will be intercepted by the sheared ring 180, backed-up by the fixed shearing ring 172, with the result that material will be sheared from the carrier member 140, along the tapered portion 182, as shown at 189. The gradual increase in the energy required to shear material 189 from the carrier member 140 along the tapered portion 182 thereof effects deceleration of the female contact assembly 170 such that the female contact assembly 170 will be halted effectively at the advanced position without failure of the bushing insert 110.

Preferably, a slight undercut is provided at 196, between the shearable ring 180 and the stop shoulder 176 so as to facilitate the venting of excessive arc-quenching gases through vent ports 194 and passage 192 after seals 190 pass beyond the forward end 136 of tubular nosepiece 132.

Figure 7:
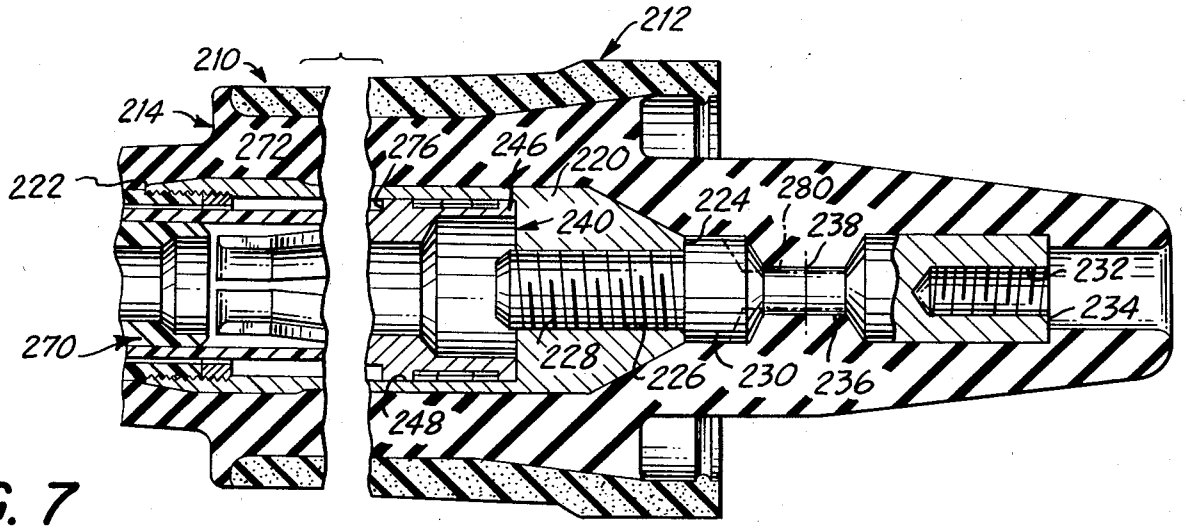
FIG. 7 is a fragmented longitudinal cross-sectional view of portions of still another electrical connector element constructed in accordance with the invention.

FIG. 7 illustrates fragmented portions of another bushing insert 210 constructed in accordance with the invention. The most forward portion of bushing insert 210, which is not illustrated in FIG. 7, may be constructed essentially the same as the forward portion of the bushing inserts 10 and 110 described above. The arrangement wherein a housing 212 includes an outer housing casing 214 of elastomeric materials and a rigid, metallic, electrically conductive inner housing member 220 having a forward end 222 and a rearward end 224 with a threaded aperture 226 at the rearward end 224 is the same as that of either bushing insert 10 or bushing insert 110. In this instance, however, the threaded stud 228 which is received within threaded aperture 226 is a part of a metallic, electrically conductive extension 230 which, in addition to providing a further threaded aperture 232 at the remote end 234 thereof for attachment to a high voltage circuit, such as the terminal of a transformer (not shown), includes kinetic energy absorption and dissipation means as follows.

Between the threaded stud 228 and the threaded aperture 232, extension 230 includes an axially-extending portion in the form of neck 236 provided with a predetermined transverse cross-sectional area, as at 238, which will enable neck 236 to become permanently deformed through axial elongation in response to an axially directed force of sufficient magnitude applied to neck 236. As in the earlier-described embodiments, bushing insert 210 includes a carrier member 240 having a piston 246 received within the inner surface 248 of inner housing member 220. The carrier member 240 is movable within the inner housing member 220 between a retracted location, wherein the piston 246 is at the rearward end 224 of the inner housing member 220, and an advanced location, wherein the carrier member 240, and the female contact assembly 270 of which carrier member 240 is a part, is located adjacent the forward end 222 of the inner housing member 220 with a stop shoulder 276 on the piston 246 coupled with a stop ring 272 affixed to the inner housing member 220 to confine the carrier member 240 within the inner housing member 220.

Should the kinetic energy of the female contact assembly 270 be great enough to cause potential damage to the bushing insert 210 once further movement of the female contact assembly 270 within the inner housing member 220 is constrained by the aforesaid coupling of the stop shoulder 276 with the inner housing member 220, at least some of the kinetic energy will be absorbed and dissipated by the elongation and permanent deformation of neck 236 of extension 230, as shown exaggerated in phantom at 280 for illustrative purposes. Thus, the predetermined cross-sectional area at 238 is chosen, along with the appropriate axial length of neck 236, so that enough of the kinetic energy of the female contact assembly 270 will be absorbed and dissipated upon the impact resulting from the coupling of stop shoulder 276 with stop ring 272 to preclude a catastrophic failure in the bushing insert 210.

Figure 8:
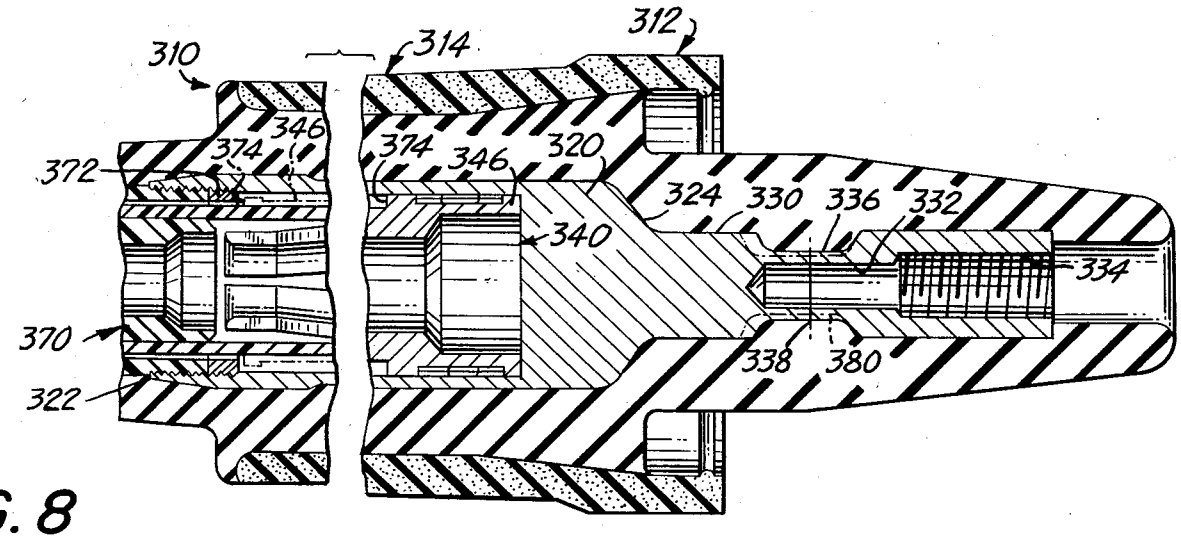
FIG. 8 is a fragmented longitudinal cross-sectional view of portions of yet another electrical connector element constructed in accordance with the invention.

Turning now to FIG. 8, yet another embodiment of the invention is illustrated in the form of bushing insert 310. Bushing insert 310 also is similar to the earlier-described embodiments in that a housing 312 includes an outer housing casing 314 of elastomeric materials and a rigid, metallic, electrically conductive inner housing member 320 which extends longitudinally between a forward end 322 and a rearward end 324 within outer housing casing 314. The construction of inner housing member 320 differs, however, from that of the corresponding component part of the aforesaid embodiments in that a rearward extension 330 is unitary with the inner housing member 320 at the rearward end 324. A blind hole 332 is located in the extension 330, a portion of which is threaded at 334 for attachment to a high voltage circuit. Blind hole 332 extends forward beyond the threaded portion 334 to establish a tubular neck 336 in the extension 330 between the rearward end 324 of the inner housing member 320 and the threaded portion 334. Tubular neck 336 is provided with a carefully chosen predetermined cross-sectional area, as at 338, along with the appropriate axial length, for purposes which will be more fully described below.

Located within the inner housing member 320 is a carrier member 340 having a piston 346 movable within the inner housing member 320 such that the carrier member 340 will move axially between a retracted location, illustrated in full lines, and an advanced location, illustrated in phantom, in much the same manner as set forth in connection with the above-described embodiments. Carrier member 340 and piston 346 thereof are parts of a female contact assembly 370 similar to the corresponding female contact assemblies of the above bushing inserts 10, 110 and 210. A stop member in the form of stop ring 372 is affixed to the inner housing member 320 and a stop shoulder 374 is located on piston 346.

When the female contact assembly 370 moves forward in response to the pressure of arc-quenching gases generated upon fault closure, the female contact assembly 370 will be accelerated to a high speed and the stop shoulder 374 will engage the stop ring 372. In order to decelerate the female contact assembly 370 and bring it to a halt without a catastrophic failure in the bushing insert, axial forward movement of the female contact assembly 370 subsequent to impact resulting from coupling of the stop shoulder 374 with stop ring 372 is transmitted to tubular neck 336 of rearward extension 330 which will elongate, as shown exaggerated in phantom at 380, in response to the axial force exerted over the cross-sectional area at 338. The permanent deformation of tubular neck 336 thus serves to absorb and dissipate a sufficient amount of the kinetic energy of female contact assembly 370 to preclude failure of the bushing insert 10, as well as failure of the connection, at threaded portion 334, with the high voltage circuit. The tubular neck 336 provides the advantage of making available higher torsional strength for the predetermined cross-sectional area 338 when the bushing insert 10 is assembled with the terminal of the high voltage circuit.

It is noted that the absorption and dissipation of kinetic energy of the moving female contact assembly is accomplished in each of the above-described embodiments either through means of a material shearing arrangement or through means of a material deformation arrangement or a combination of both means. Thus, bushing inserts 10 and 110 may include a permanently deformable neck 236 in the respective extensions 30 and 130 to supplement the material shearing arrangements of those bushing inserts in absorbing and dissipating kinetic energy, but need not include such a supplementary kinetic energy absorption and dissipation means. On the other hand, the permanently deformable neck 236 of bushing insert 210 may be employed as the sole kinetic energy absorption and dissipation means in bushing insert 210 or may be supplemented by the material shearing means disclosed in connection with the description of bushing inserts 10 and 110. Likewise, the tubular neck 336 of rearward extension 330 in bushing insert 310 may serve as the sole means for absorbing and dissipating kinetic energy or may be supplemented by the material shearing means disclosed in the earlier-described embodiments.

It is to be understood that the above detailed description of embodiments of the invention are provided by way of example only. Various details of design and construction may be modified without departing from the true spirit and scope of the invention as set forth in the appended claims.

The embodiments of the invention in which an exclusive property or privilege is claimed are defined as follows:

1. In an electrical connector of the type in which a contact element assembly is movable within the electrical connector from a first position to a second position to accelerate a first contact element for rapid movement toward engagement with a complementary second contact element brought toward separable engagement with the first contact element within the electrical connector to complete an energized high voltage circuit, the improvement comprising: kinetic energy absorption and dissipation means associated with the electrical connector and constructed for gradually absorbing and dissipating at least a portion of the kinetic energy imparted to the contact element assembly as a result of such acceleration as the contact element assembly moves from the first position toward the second position, the construction of the kinetic energy absorption and dissipation means being such that the absorbed and dissipated portion of the kinetic energy is great enough to subsequently decelerate the contact element assembly sufficiently to facilitate bringing the contact element assembly to a halt subsequent to the engagement of the first and second contact elements.

2. The invention of claim 1 wherein the first contact element will engage the second contact element at a third position of the contact element assembly intermediate the first position and the second position, and the kinetic energy absorption and dissipation means is located relative to the first and second contact elements such that the greatest portion of the kinetic energy is absorbed and dissipated during movement of the contact element assembly from the intermediate third position toward the second position.

3. In an electrical connector of the type in which a contact element assembly is movable within the electrical connector from a first position to a second position to accelerate a first contact element for rapid movement toward engagement with a complementary second contact element brought toward separable engagement with the first contact element within the electrical connector to complete an energized high voltage circuit, the improvement comprising:

an axially extending tubular housing member within the electrical connector;

a carrier member carrying the first contact element and movable axially within the tubular housing member between a first location, corresponding to the first position of the contact element assembly, and a second location, corresponding to the second position of the contact element assembly;

a stop member fixed in the tubular housing member;

a stop shoulder on the carrier member spaced a first axial distance from the stop member when the carrier member is in the first location; and kinetic energy absorption and dissipation means associated with the electrical connector for gradually absorbing and dissipating at least a portion of the kinetic energy imparted to the contact element assembly as a result of such acceleration as the contact element assembly moves from the first position toward the second position so as subsequently to decelerate the contact element assembly and thereby facilitate bringing the contact element assembly to a halt subsequent to the engagement of the first and second contact elements;

the kinetic energy absorption and dissipation means including shearable means on the carrier member and located between the stop member and the stop shoulder in position to be engaged by the stop shoulder upon axial movement of the carrier member from the first location to the second location for shearing in response to such engagement with the stop member so as to absorb and dissipate kinetic energy as the carrier member moves axially from the first location to the second location, whereby the carrier member will arrive at the second location with kinetic energy diminished by the amount absorbed and dissipated by shearing of the shearable means.

4. The invention of claim 3 wherein the shearable means includes at least one shearable member integral with the carrier member between the stop member and the stop shoulder and capable of being sheared therefrom in response to engagement with the stop member during axial movement of the carrier member from the first location to the second location.

5. The invention of claim 3 wherein the shearable means includes a tapered portion located on the carrier member so as to be capable of being sheared from the carrier member by means of the stop member as the carrier member is moved axially from the first location to the second location.

6. The invention of claim 3 wherein the shearable means includes:

a primary shearable member integral with the carrier member between the stop member and the stop shoulder and capable of being sheared therefrom in response to engagement with the stop member during axial movement of the carrier member from the first location to the second location; and a secondary shearable structure between the primary shearable member and the stop shoulder, the secondary shearable structure being capable of being sheared from the carrier member in response to engagement with the sheared primary shearable member during axial movement of the carrier member from the first location to the second location.

7. The invention of claim 6 wherein the secondary shearable structure includes a plurality of shearable secondary members located on the carrier member so as to be capable of being sheared from the carrier member by means of the stop member as the carrier member is moved axially from the first location to the second location.

8. The invention of claim 6 wherein the secondary shearable structure includes a tapered portion located on the carrier member so as to be capable of being sheared from the carrier member by means of the stop member as the carrier member is moved axially from the first location to the second location.

9. The invention of claim 3 wherein:

the tubular housing member is generally cylindrical and includes a generally cylindrical internal surface;

the carrier member is generally tubular and includes a forward end and a rearward end;

the first contact element includes a female contact adjacent the forward end of the carrier member;

a piston integral with the carrier member adjacent the rearward end thereof is fitted into the internal surface of the tubular housing member for axial sliding movement therein;

the shearable means includes a shearable structure located on the tubular carrier member axially forward of the piston for axial movement along a path of travel in response to axial movement of the piston within the internal surface of the tubular housing member, the shearable structure extending radially toward the tubular housing member; and the stop member includes a shearing ring located on the tubular housing member and projecting radially into the path of travel followed by the shearable structure as the tubular carrier member moves axially from the first location to the second location.

10. The invention of claim 9 wherein the shearable structure includes at least one shearable ring on the tubular carrier member and projecting radially toward the tubular housing member.

11. The invention of claim 9 or 10 wherein the shearable structure includes an axially tapered portion on the tubular carrier member forward of the piston, the tapered portion tapering from an axially-forward smaller radius toward an axially-rearward larger radius.

12. The invention of claim 9 wherein the shearable structure includes a plurality of shearable rings on the tubular carrier member, each spaced axially from another and each projecting radially toward the tubular housing member.

13. The invention of claim 3 wherein the kinetic energy absorption and dissipation means further includes axially deformable means integral with the tubular housing member for being permanently deformed axially to permit further movement of the carrier member axially in response to coupling of the stop shoulder for movement with the stop member toward the first location so as to absorb and dissipate kinetic energy as the carrier member moves to the second location subsequent to said coupling of the stop shoulder with the stop member.

14. The invention of claim 13 wherein the axially deformable means includes an axially-extending neck of permanently deformable material of predetermined cross-sectional area and axial length integral with the tubular housing member.

15. The invention of claim 9 wherein the kinetic energy absorption and dissipation means further includes axially deformable means integral with the tubular housing member for being permanently deformed axially to permit further movement of the carrier member axially in response to coupling of the stop shoulder for movement with the stop member toward the first location so as to absorb and dissipate kinetic energy as the carrier member moves to the second location subsequent to said coupling of the stop shoulder with the stop member;

the tubular housing member has a forward end corresponding to the forward end of the carrier member and a rearward end corresponding to the rearward end of the carrier member; and the axially deformable means is located adjacent the rearward end of the tubular housing member.

16. The invention of claim 15 wherein the axially deformable means includes a neck of permanently deformable material integral with the tubular housing member and extending axially rearwardly beyond the internal surface of the tubular housing member, the neck having a predetermined cross-sectional area and axial length and being capable of elongation to absorb and dissipate kinetic energy as the carrier member moves to the second location subsequent to said coupling of the stop shoulder with the stop member.

17. In an electrical connector of the type in which a contact element assembly is movable within the electrical connector from a first position to a second position to accelerate a first contact element for rapid movement toward engagement with a complementary second contact element brought toward separable engagement with the first contact element within the electrical connector to complete an energized high voltage circuit, the improvement comprising:

an axially extending tubular housing member within the electrical connector;

a carrier member carrying the first contact element and movable axially within the tubular housing member between a first location, corresponding to the first position of the contact element assembly, and a second location, corresponding to the second position of the contact element assembly;

a stop member fixed in the tubular housing member;

a stop shoulder on the carrier member spaced a first axial distance from the stop member when the carrier member is in the first location;

kinetic energy absorption and dissipation means associated with the electrical connector for gradually absorbing and dissipating at least a portion of the kinetic energy imparted to the contact element assembly as a result of such acceleration as the contact element assembly moves from the first position toward the second position so as subsequently to decelerate the contact element assembly and thereby facilitate bringing the contact element assembly to a halt subsequent to the engagement of the first and second contact element;

the kinetic energy absorption and dissipation means including axially deformable means integral with the tubular housing member for being permanently deformed axially to permit movement of the carrier member axially in response to coupling of the stop shoulder for movement with the stop member toward the first location so as to absorb and dissipate kinetic energy as the carrier member moves to the second location subsequent to said coupling of the stop shoulder with the stop member.

18. The invention of claim 17 wherein the axially deformable means includes an axially-extending neck of permanently deformable material of predetermined cross-sectional area and axial length integral with the tubular housing member.

19. The invention of claim 17 wherein:

the tubular housing member is generally cylindrical and includes a generally cylindrical internal surface;

the carrier member is generally tubular and includes a forward end and a rearward end;

the first contact element includes a female contact adjacent the forward end of the carrier member;

a piston integral with the carrier member adjacent the rearward end thereof is fitted into the internal surface of the tubular housing member for axial sliding movement therein;

the tubular housing member has a forward end corresponding to the forward end of the carrier member and a rearward end corresponding to the rearward end of the carrier member; and the axially deformable means is located adjacent the rearward end of the tubular housing member.

20. The invention of claim 19 wherein the axially deformable means includes a neck of permanently deformable material integral with the tubular housing member and extending axially rearwardly beyond the internal surface of the tubular housing member, the neck having a predetermined cross-sectional area and axial length and being capable of elongation to absorb and dissipate kinetic energy as the carrier member moves to the second location subsequent to said coupling of the stop shoulder with the stop member.

21. The invention of claim 5, 6, 7, 8, 9, 13, 15, 17 or 19 wherein the first contact element will engage the second contact element at a third position of the contact element assembly intermediate the first position and the second position, and the kinetic energy absorption and dissipation means is located relative to the first and second contact elements such that the greatest portion of the kinetic energy is absorbed and dissipated during movement of the contact element assembly from the intermediate third position toward the second position.

22. A female electrical connector for use in separably connecting a male contact element with an energized high voltage circuit, said connector comprising a rigid conductive housing having a first end adapted to receive said male contact element, a second end adapted to be substantially closed and an internal wall surface providing an axially extending opening therebetween, an elongate female contact assembly including a tubular piston of conductive material within and in electrically conductive relationship with said housing and axially movable between a first position wherein said piston is maximally spaced from said first housing end and a second position wherein said piston is minimally spaced from said first housing end, said piston providing said connector with a chamber adjacent said second housing end, and female contact means for engaging said male contact element, said female contact means being carried by and movable with and in electrically conductive relationship with said piston, said female contact assembly being configured to transmit to said chamber arc-quenching gas which is generated in response to an arc being struck between said male contact element and said female contact means as said male contact element approaches said female contact means so as to accelerate the female contact means for rapid movement toward the male contact element, said connector further comprising kinetic energy absorption and dissipation means associated with the housing and the female contact means and constructed for gradually absorbing and dissipating at least a portion of the kinetic energy imparted to the female contact means as a result of such acceleration as the piston moves from the first position to the second position, the construction of the kinetic energy absorption and dissipation means being such that the absorbed and dissipated portion of the kinetic energy is great enough to subsequently decelerate the female contact means sufficiently to facilitate bringing the female contact means to a halt subsequent to engagement of the female contact means with the male contact element.

23. The invention of claim 22 wherein the female contact means will engage the male contact element at a third position of the piston intermediate the first position and the second position, and the kinetic energy absorption and dissipation means is located relative to the female contact means and the male contact element such that the greatest portion of the kinetic energy is absorbed and dissipated during movement of the piston from the intermediate third position toward the second position.

24. A female electrical connector for use in separably connecting a male contact element with an energized high voltage circuit, said connector comprising:

a rigid conductive housing having a first end adapted to receive said male contact element, a second end adapted to be substantially closed and an internal wall surface providing an axially extending opening therebetween;

an elongate female contact assembly including a tubular piston of conductive material within and in electrically conductive relationship with said housing and axially movable between a first position wherein said piston is maximally spaced from said first housing end and a second position wherein said piston is minimally spaced from said first housing end, said piston providing said connector with a chamber adjacent said second housing end:

female contact means for engaging said male contact element, said female contact means being carried by and movable with and in electrically conductive relationship with said piston, said female contact assembly being configured to transmit to said chamber arc-quenching gas which is generated in response to an arc being struck between said male contact element as said male contact element approaches said female contact means so as to accelerate the female contact means for rapid movement toward the male contact element;

a stop member fixed in the housing;

a stop shoulder on the female contact assembly spaced axially from the stop member when the piston is in the first position; and kinetic energy absorption and dissipation means associated with the housing and the female contact means for gradually absorbing and dissipating at least a portion of the kinetic energy imparted to the female contact means as a result of such acceleration as the piston moves from the first position to the second position so as subsequently to decelerate the female contact means and thereby facilitate bringing the female contact means to a halt subsequent to engagement of the female contact means with the male contact element;

the kinetic energy absorption and dissipation means including shearable means on the female contact assembly, between the stop member and the stop shoulder and in position to be engaged by the stop shoulder upon axial movement of the piston from the first position to the second position, for shearing in response to such engagement with the stop shoulder to absorb and dissipate kinetic energy as the piston moves from the first position to the second position, whereby the piston will arrive at the second position with the kinetic energy of the female contact assembly diminished by the amount absorbed and dissipated by shearing of the shearable means.

25. The invention of claim 24 wherein the shearable means includes at least one shearable member integral with the female contact assembly between the stop member and the stop shoulder and capable of being sheared therefrom in response to engagement with the stop member during axial movement of the piston from the first position to the second position.

26. The invention of claim 24 wherein the shearable means includes a tapered portion located on the female contact assembly so as to be capable of being sheared from the female contact assembly by means of the stop member as the piston is moved axially from the first position to the second position.

27. The invention of claim 24 wherein the shearable means includes:

a primary shearable member integral with the female contact assembly between the stop member and the stop shoulder and capable of being sheared therefrom in response to engagement with the stop member during axial movement of the piston from the first position to the second position; and a secondary shearable structure between the primary shearable member and the stop shoulder, the secondary shearable structure being capable of being sheared from the female contact assembly in response to engagement with the sheared primary shearable member during axial movement of the piston from the first position to the second position.

28. The invention of claim 27 wherein the secondary shearable structure includes a plurality of shearable secondary members located on the female contact assembly so as to be capable of being sheared from the female contact assembly by means of the stop member as the piston is moved axially from the first position to the second position.

29. The invention of claim 27 wherein the secondary shearable structure includes a tapered portion located on the female contact assembly so as to be capable of being sheared from the female contact assembly by means of the stop member as the piston is moved axially from the first position to the second position.

30. The invention of claim 24 wherein:

the shearable means includes a shearable structure located on the female contact assembly axially forward of the piston for axial movement along a path of travel in response to axial movement of the piston within the housing, the shearable structure extending radially toward the internal wall surface of the housing; and the stop member includes a shearing ring located in the housing and projecting radially into the path of travel followed by the shearable structure as the piston moves axially from the first position to the second position.

31. The invention of claim 30 wherein the shearable structure includes at least one shearable ring on the female contact assembly and projecting radially toward the internal wall surface of the housing.

32. The invention of claim 30 or 31 wherein the shearable structure includes an axially tapered portion on the female contact assembly forward of the piston, the tapered portion tapering from an axially-forward smaller radius toward an axially-rearward larger radius.

33. The invention of claim 30 wherein the shearable structure includes a plurality of shearable rings on the female contact assembly, each spaced axially from another and each projecting radially toward the internal wall surface of the housing.

34. The invention of claim 24 wherein the kinetic energy absorption and dissipation means further includes axially deformable means integral with the housing for being permanently deformed axially to permit further movement of the piston toward the first position in response to coupling of the stop shoulder with the stop member so as to absorb and dissipate kinetic energy as the piston moves to the second position subsequent to said coupling of the stop shoulder with the stop member.

35. The invention of claim 34 wherein the axially deformable means includes an axially-extending neck of permanently deformable material of predetermined cross-sectional area and axial length integral with the housing.

36. The invention of claim 30 wherein the kinetic energy absorption and dissipation means further includes axially deformable means integral with the housing for being permanently deformed axially to permit further movement of the piston toward the first position in response to coupling of the stop shoulder with the stop member so as to absorb and dissipate kinetic energy as the piston moves to the second position subsequent to said coupling of the stop shoulder with the stop member; and the axially deformable means is located adjacent the second end of the housing.

37. The invention of claim 36 wherein the axially deformable means includes a neck of permanently deformable material integral with the housing and extending axially rearwardly beyond the internal wall surface of the housing, the neck having a predetermined cross-sectional area and axial length and being capable of elongation to absorb and dissipate kinetic energy as the piston moves to the second position subsequent to said coupling of the stop shoulder with the stop member.

38. A female electrical connector for use in separably connecting a male contact element with an energized high voltage circuit, said connector comprising:

a rigid conductive housing having a first end adapted to receive said male contact element, a second end adapted to be substantially closed and an internal wall surface providing an axially extending opening therebetween;

an elongate female contact assembly including a tubular piston of conductive material within and in electrically conductive relationship with said housing and axially movable between a first position wherein said piston is maximally spaced from said first housing end and a second position wherein said piston is minimally spaced from said first housing end, said piston providing said connector with a chamber adjacent said second housing end;

female contact means for engaging said male contact element, said female contact means being carried by and movable with and in electrically conductive relationship with said piston, said female contact assembly being configured to transmit to said chamber arc-quenching gas which is generated in response to an arc being struck between said male contact element and said female contact means as said male contact element approaches said female contact means so as to accelerate the female contact means for rapid movement toward the male contact element;

a stop member fixed in the tubular housing member;

a stop shoulder on the female contact assembly spaced axially from the stop member when the piston is in the first position; and kinetic energy absorption and dissipation means associated with the housing and the female contact means for gradually absorbing and dissipating at least a portion of the kinetic energy imparted to the female contact means as a result of such acceleration as the piston moves from the first position to the second position so as subsequently to decelerate the female contact means and thereby facilitate bringing the female contact means to a halt subsequent to engagement of the female contact means with the male contact element;

the kinetic energy absorption and dissipation means including axially deformable means integral with the housing for being permanently deformed axially to permit further movement of the piston toward the first position in response to coupling of the stop shoulder with the stop member so as to absorb and dissipate kinetic energy as the piston moves to the second position subsequent to said coupling of the stop shoulder with the stop member.

39. The invention of claim 38 wherein the axially deformable means includes an axially-extending neck of permanently deformable material of predetermined cross-sectional area and axial length integral with the housing.

40. The invention of claim 39 wherein the axially deformable means is located adjacent the second end of the housing.

41. The invention of claim 40 wherein the axially deformable means includes a neck for permanently deformable material integral with the housing and extending axially rearwardly beyond the internal wall surface of the housing, the neck having a predetermined cross-sectional area and axial length and being capable of elongation to absorb and dissipate kinetic energy as the piston moves to the second position subsequent to said coupling of the stop shoulder with the stop member.

42. The invention of claim 26, 27, 28, 29, 30, 34, 36, 38 or 40 wherein the female contact means will engage the male contact element at a third position of the piston intermediate the first position and the second position, and the kinetic energy absorption and dissipation means is located relative to the female contact means and the male contact element such that the greatest portion of the kinetic energy is absorbed and dissipated during movement of the piston from the intermediate third position toward the second position.

* * * * *